United States Patent [19]

Ebata et al.

[11] Patent Number: 4,717,030

[45] Date of Patent: Jan. 5, 1988

[54] TURBINE BUILDING EQUIPPED WITH OVERHEAD TRAVELING CRANES

[75] Inventors: Sakae Ebata, Hitachi; Seiichi Inoue, Yokohama, both of Japan

[73] Assignee: Hitachi, Ltd., Tokyo, Japan

[21] Appl. No.: 936,606

[22] Filed: Dec. 1, 1986

[30] Foreign Application Priority Data

Nov. 29, 1985 [JP] Japan ..... 60-267163

[51] Int. Cl.[4] ..... B66C 17/00

[52] U.S. Cl. ..... 212/205; 212/271

[58] Field of Search ..... 212/205, 213, 220, 221, 212/270, 271, 206

[56] References Cited

U.S. PATENT DOCUMENTS

| | | | |
|---|---|---|---|
| 672,788 | 4/1901 | Lieber et al. | 212/213 |
| 1,712,650 | 5/1929 | Clark | 212/205 |
| 4,439,905 | 4/1984 | Gourdon et al. | 212/213 |
| 4,561,551 | 12/1985 | Goussinsky | 212/205 |

FOREIGN PATENT DOCUMENTS

| | | | |
|---|---|---|---|
| 35760 | 6/1978 | Japan | 212/205 |
| 1179219 | 1/1970 | United Kingdom | 212/206 |
| 621637 | 8/1978 | U.S.S.R. | 212/205 |

*Primary Examiner*—Jeffrey V. Nase
*Assistant Examiner*—Stephen P. Avila
*Attorney, Agent, or Firm*—Antonelli, Terry & Wands

[57] ABSTRACT

A building for accomodating turbines and a generator in a power plant is equipped with overhead traveling cranes and constructed so that the overhead traveling cranes are arranged to travel in parallel with each other in a direction perpendicular to an axis of the turbines and the generator. The crane rails for supporting the overhead traveling cranes are arranged in parallel with one another in a direction perpendicular to the axis of the turbine and generator.

2 Claims, 4 Drawing Figures

TURBINE BUILDING EQUIPPED WITH OVERHEAD TRAVELING CRANES

BACKGROUND OF THE INVENTION

This invention relates to a turbine building equipped with overhead traveling cranes in a power plant, and more particularly, to a turbine building for accommodating turbines and a generator in a power plant, which building is provided with overhead traveling cranes exclusively used by the turbines and the generator, respectively, and suitable for reducing the time required for inspection of disassembled parts of the turbines and the generator.

A conventional turbine building in a power plant is equipped with one or more overhead traveling cranes which travel in parallel with the axis of the turbines and the generator. The traversing distance between crane rails of the overhead traveling crane is limited to about 40 m in order to avoid unnecessary extension of the building and a reduction in the strength of the crane supports. The area between the crane rails is not sufficient to carry out disassembling of the turbines and the generator. Therefore, it is necessary to place disassembled parts of the turbines and the generator outside the area, and to provide auxiliary equipment such as jib cranes, monorails, etc. in addition to the overhead traveling cranes.

However, such provision of the auxiliary equipment is not favorable because such additional works that the disassembled parts are transferred from or to the overhead traveling cranes to or from the jib cranes and monorails are necessary and they make the inspection work of the turbines and generator complicated and inefficient. Further, it is not favorable in view of the cost of equipment.

Japanese Patent Laid-Open No. 55-35760/1980 discloses an overhead traveling crane which is provided with means for extending a traveling area of the hook. The means, however, do not sufficiently extend the hook traveling scope in a direction perpendicular to the crane rails.

Therefore, it is desired to improve the way of the inspection work in order to reduce the inspection time.

On the other hand, a span between overhead traveling crane rails equipped in a conventional turbine building in a nuclear power plant is limited to about 45 m and a space within the span also is not enough to dispose the disassembled parts, so that there is provided an auxiliary space outside the space within which the overhead traveling cranes can travel, the inspection working is carried out in the space and the auxiliary space using auxiliary equipment.

SUMMARY OF THE INVENTION

An object of the invention is to provide a turbine building equipped with a plurality of overhead traveling cranes, which building is constructed so as to be able to reduce a time necessary to inspect a turbine and a generator in a power plant.

Another object of the invention is to provide a building for accommodating a turbine and a generator, which building is equipped with a plurality of overhead traveling cranes each exclusively used for the turbine and the generator, respectively, and enables the cranes to suspend and transfer the disassembled parts of the turbine and the generator all over the area of the building in a perpendicular direction to the axis of the turbine and to simultaneously accomplish the same with the turbine and the generator or other turbines, so that an inspection time of the turbine, generator, etc. can be reduced.

Briefly stated, the invention resides in that a building for accommodating a turbine and a generator aligned with and connected to the turbine is equipped with at least two overhead traveling cranes so as to be able to travel substantially all over the area of the building in a perpendicular direction to an axis of the turbine and the generator and to travel in the parallel with each other.

DETAILED DESCRIPTION OF THE INVENTION

Figure 1:
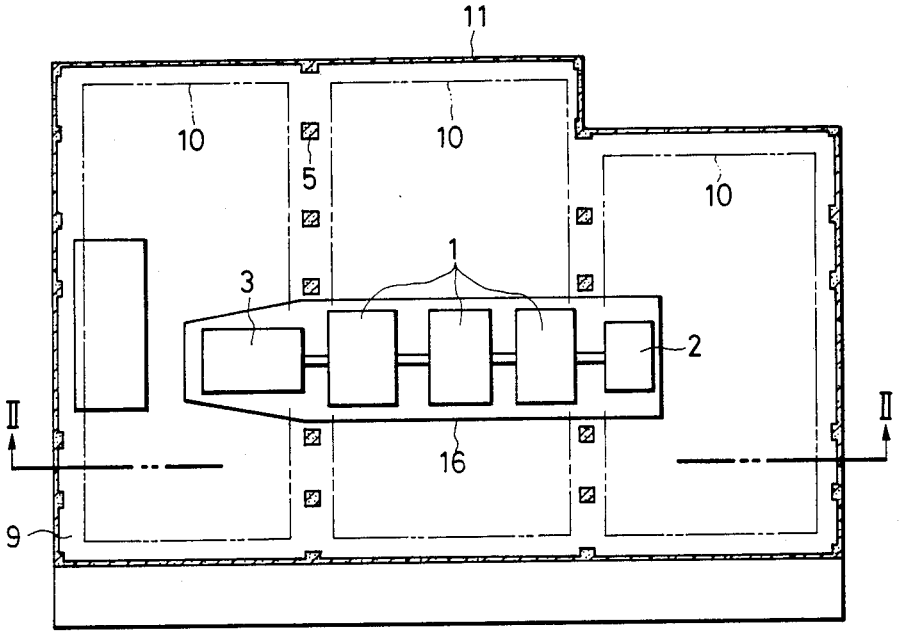
FIG. 1 is a partially schematic sectional view of a turbine building of an embodiment of the invention.

Referring now to the drawings wherein like reference numerals are used throughout the various views to designate like parts and, more particularly, to FIG. 1, according to this figure, a turbine building for accommodating a turbine and a generator in accordance with the present invention comprises a rectangular floor 9, a plurality of posts 5, side walls 11 and a roof truss, and the building is equipped with overhead traveling cranes 4. The floor 9 has a support floor 16 on which low pressure turbines 1, a high pressure turbine 2 and a generator 3 are mounted, with the support floor 16 being substantially the same in level as the floor 9. The low pressure turbines 1, the high pressure turbine 2 and the generator 3 are mechanically connected in alignment along a common straight central axis. The above-mentioned connected turbines 1, 2 and the generator 3 are simply referred to as a turbine set hereunder.

Figure 2:
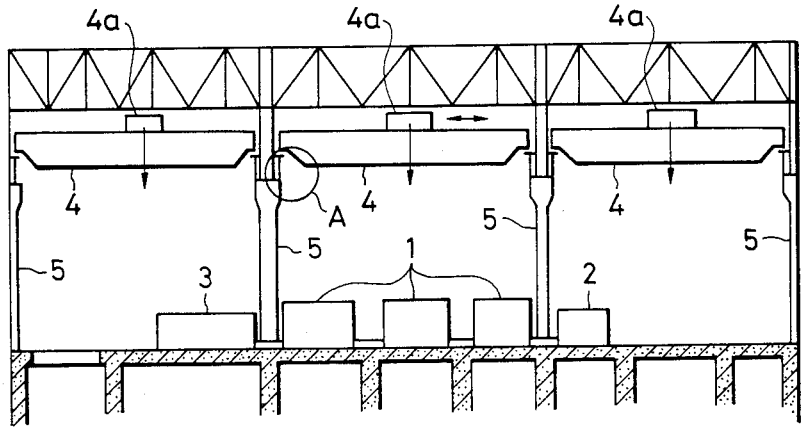
FIG. 2 is a partially schematic vertical sectional view taken along a line II—II of FIG. 1.

The floor 9 is substantially rectangular and the turbine set is arranged on the floor 9 so that the central axis is in parallel with a long side of the rectangular floor 9. The posts 5 for supporting the overhead traveling cranes 4 are arranged in four rows each of which is perpendicular to the central axis of the turbine set. As shown in FIG. 2, the overhead traveling cranes 4 are supported by the posts 5 so as to travel in a perpendicular direction to the central axis of the turbine set.

Figure 3:
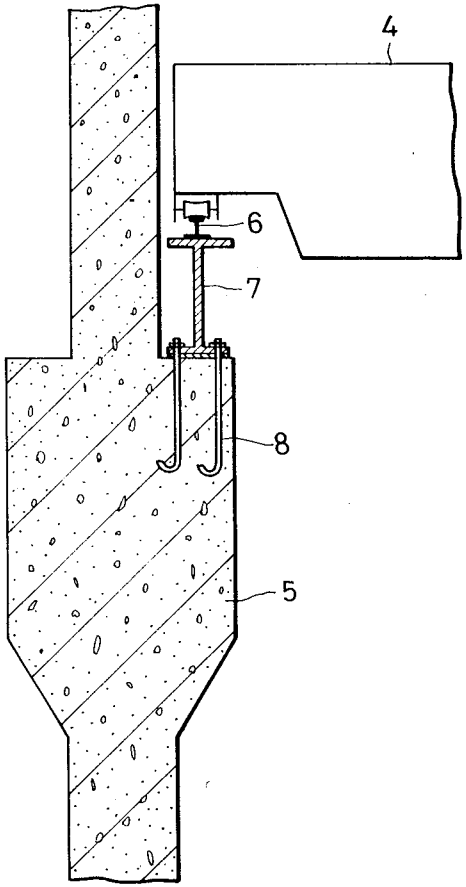
FIG. 3 is an enlarged sectional view of a portion of FIG. 2 enclosed by a line A.

As shown in FIG. 3, each of the posts 5 are of a reinforced concrete construction, and have an I beam 7 extending along the row of the posts 5 and fastened thereto by built-in anchor bolts 8. Crane rails 6 are each secured to the I beam 7. The overhead traveling crane 4 comprises a traveling girder having wheels rolling on the rail 6 at opposite ends thereof and a trolley **4*a* having a hook hung therefrom and traveling along the traveling girder in a direction in parallel with the turbine set. The construction of the overhead traveling crane 4**, itself is conventional.

In thus constructed building, the overhead traveling cranes 4 each can travel within a space enclosed by a two dotted line 10, that is, the crane hook can suspend and transfer parts of the turbine 1,2, the generator 3, auxiliary equipment, etc. placed anywhere in the space to other positions within the space without help of any other transferring equipment.

The overhead traveling cranes 4 can cover substantially all over the area of the floor 9 on which the turbine set is mounted and the disassembled parts are placed.

Referring back to FIG. 2, two of the post rows are disposed between the generator 3 and the low pressure turbine 1 and between the low pressure turbine 1 and the high pressure turbine 3, respectively, so that the crane 4 disposed left in the drawing is exclusively used for the generator 3, the crane 4 in the middle for the low pressure turbines 1 and crane 4 right for the high pressure turbine 2. As mentioned above, the overhead traveling cranes 4 each are exclusively used for the generator 3, the low pressure turbines 1 and the high pressure turbine 2, respectively. Therefore, disassembling, suspending or transferring of the generator 3, the low pressure turbines 1 and the high pressure turbine 2 can be simultaneously carried out, so that a time required to inspect the turbine set can be reduced greatly.

Figure 4:
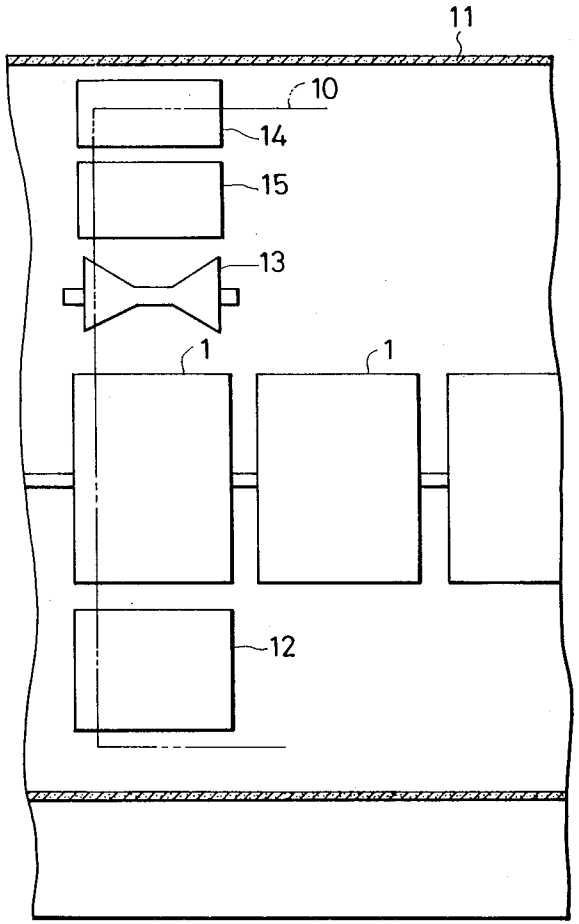
FIG. 4 is a sectional view of a part of the turbine building for explaining a disassembling process.

As shown in FIG. 4, to disassemble the turbine set, first an upper casing 12 is disassembled and the disassembled casing is suspended by one of the overhead traveling cranes 4 which is disposed between the other traveling cranes 4 and transferred to a position the turbine 1. Then, a rotor 13 is disassembled, and the disassembled rotor 13 is suspended by the same crane 4 and transferred to a position near the turbine 1 in the opposite side to the upper casing 12. An upper diaphragm 15 and a lower diaphragm 14 are transferred in a similar manner as mentioned above to the outside of the rotor 13 as shown in FIG. 4.

Assembling the disassembled parts after the inspection can be carried out in turn from the disassembled part near the original turbine position.

According to the present invention, the disassembled parts of the low and high pressure turbines 1, 2 and the generator are suspended, transferred and placed by only the overhead traveling cranes 4 during a periodic inspection without use of any auxiliary equipment such as jib cranes, monorails and without complicated works such as exchange of the disassembled parts between the overhead traveling cranes and the auxiliary equipment. The hanging, transferring, etc. of the disassembled parts can be proceeded in parallel with respect to the high and low pressure turbines 2, 1 and the generator 3, so that the periodic inspection time can be reduced by about ten days, compared with conventional inspection methods.

What is claimed is:

1. A turbine building equipped with overhead traveling cranes comprising:

a floor on which a turbine and a generator mechanically connected to and in alignment with each other are mounted, said floor having a space for placing disassembled parts of said turbine and said generator thereon during an inspection period of said turbine and said generator, said floor is substantially rectangular and includes short sides and long sides;

a plurality of overhead traveling cranes arranged above the level of said turbine and said generator so as to travel in a direction perpendicular to the axis of said turbine and generator, one of said cranes is arranged above said generator and the other of said cranes is arranged above said turbine so that said overhead traveling cranes can travel in parallel with each other;

crane rails for mounting said overhead travelling cranes, said crane rails each extending in a direction perpendicular to the axis of said turbine and generator; and means for supporting said crane rails comprising a plurality of posts arranged in rows, each of said posts extending in a direction perpendicular to the axis of said turbine and generator, said rows of said posts supporting said crane rails extending in parallel with said short sides of said substantially rectangular floor.

2. A turbine building equipped with overhead traveling cranes according to claim 1, wherein one row of said posts is disposed between said turbine and said generator.

* * * * *